United States Patent [19]

McIntyre

[11] Patent Number: 4,907,741

[45] Date of Patent: Mar. 13, 1990

[54] POPPET-VALVE-CONTROLLED FLUID NOZZLE APPLICATOR

[75] Inventor: Frederic S. McIntyre, Wellesley, Mass.

[73] Assignee: Acumeter Laboratories, Inc., Marlboro, Mass.

[21] Appl. No.: 356,593

[22] Filed: May 22, 1989

Related U.S. Application Data

[63] Continuation of Ser. No. 36,269, Apr. 9, 1987, abandoned.

[51] Int. Cl.[4] ..... B05B 1/12

[52] U.S. Cl. ..... 239/124; 239/292; 239/416; 239/457; 239/583; 239/DIG. 19

[58] Field of Search ..... 239/119, 124, 291, 292, 239/457, 583, 591, 416, DIG. 19; 137/625.5, 563; 251/63

[56] References Cited

U.S. PATENT DOCUMENTS

| | | | |
|---|---|---|---|
| 1,098,429 | 6/1914 | Coleman | 239/416 |
| 1,869,675 | 8/1932 | Easley | 239/291 X |
| 2,626,122 | 1/1953 | Lammiman | 239/292 X |
| 2,682,429 | 6/1954 | Fortino | 239/591 |
| 3,066,874 | 12/1962 | Becker | 239/416 X |
| 3,198,434 | 8/1965 | Svrchek | 239/291 X |
| 3,329,347 | 7/1967 | Montgomery | 239/583 |
| 3,348,520 | 10/1967 | Lockwood | 239/119 X |
| 3,387,783 | 6/1968 | Schellenberg et al. | 239/81 |
| 3,515,354 | 6/1970 | Presson | 239/582.1 X |
| 3,595,204 | 7/1971 | McIntyre et al. | 118/8 |
| 3,735,929 | 5/1973 | Pleines | 239/416 X |
| 4,020,194 | 4/1977 | McIntyre et al. | 427/172 |
| 4,476,165 | 10/1984 | McIntyre | 427/258 |
| 4,528,782 | 7/1985 | Bean | 239/591 |
| 4,565,217 | 1/1986 | McIntyre | 137/625.5 |
| 4,650,119 | 3/1987 | Pomponi, Jr. | 239/296 |

*Primary Examiner*—Andres Kashnikow
*Assistant Examiner*—William Grant
*Attorney, Agent, or Firm*—Rines and Rines, Shapiro and Shapiro

[57] ABSTRACT

A novel preferably poppet-valve-controlled fluid applicator for extruding hot melt and other coating fluids and the like as fibers or filaments and/or droplets upon moving webs and other surfaces wherein the valve seat tip blocks or permits the flow of the fluid into a hollow nozzle insert communicating with, preferably, a needle-like nozzle tube spray extruder, with provision for adjustment to produce controlled fiber and/or droplet spray coatings, and preferably though optionally with air-shaping control of the coatings.

15 Claims, 8 Drawing Sheets

POPPET-VALVE-CONTROLLED FLUID NOZZLE APPLICATOR

This is a continuation application of Ser. No. 036,269 filed Apr. 9, 1987, now abandoned.

The present invention relates to fluid nozzle applicator systems, being more particularly directed to such systems controlled by mechanical or electromechanical valving devices for enabling metered intermittent, patterned, or continuous coatings to be deposited in controlled thickness from the nozzles upon moving webs or other surfaces, as in the application of hot melt adhesives and other coating fluids such as those described, for example, in U.S. Pat. Nos. 3,595,204, 4,020,194 and 4,476,165.

Prior valves for enabling such operation, particularly with longitudinal slot nozzles and the like, as described in said patents, have included two-way poppet valves with a single fluid supply inlet to the valve assembly (such as the type described in "Extruder Valve", a 1977 bulletin of Acumeter Laboratories, Inc., the assignee of the present invention), and more recently three-way poppet valve structures enabling precise and constant thickness patterns of fluid coating with negligible after-drool and with a very short stroke that permits more rapid on/off cycle times-such being described in my U.S. Pat. No. 4,565,217.

While such and other valving structures are particularly suited to the types of fluid extrusion or deposition nozzles above-referenced and similar extruders, there are occasions where it is desired to spray or even atomize or fiberize the fluid upon the moving web or other surface, which requires the use of finer nozzle orifices and even needle-like nozzles with fine dispensing openings. It is more particularly to the adaption of poppet-valves to such extruding and preferably said three-way poppet valves to such extruding spray-like or atomizing or fiberizing nozzles or heads that the present invention is principally (though not exclusively) directed, such nozzle dispensers having properties and characteristics often quite distinct from the before-mentioned types of extrusion nozzles.

An object of the present invention, accordingly, is to provide a new and improved poppet-valve-controlled fluid nozzle applicator particularly useful, though not exclusively, with such extruded spray or atomizing type dispensing applicators and the like.

A further object is to provide such a novel applicator that operates with a preferred three-way poppet valve.

Still another object is to provide a novel applicator for the intermittent (and continuous) extrusion or spray of fluids through fine needle-like nozzles or dispensers; and further, where desired, to enable the shaping, varying or controlling of the fluid spray in a defined manner during the extrusion.

Other and further objects will be explained hereinafter and are more particularly delineated in the appended claims.

In summary, however, from one of its important aspects, the invention embraces a poppet valve-controlled fluid nozzle applicator system, having, in combination, a longitudinally extending valve stem reciprocally mounted within communicable upper and lower longitudinally displaced fluid chambers, the lower of which transversely communicates with a pressurized and metered fluid supply source and the upper of which communicates transversely with a fluid return path, the valve stem carrying a poppet valve having upwardly and downwardly converging surface sections and contained within the lower chamber; the region of communicating of the upper and lower chambers comprising the valve seat against which the upwardly convergingly shaped surfaces of the poppet valve may bear to close off the upper chamber from the lower chamber when the valve stem reciprocates upward, and with the lower downwardly converging surfaces of the poppet valve terminating in a valve tip; a nozzle applicator mounted to depend from the region of lowermost reciprocation of the poppet valve tip and comprising a hollow insert into which the tip may fit to block fluid flow from the lower chamber into the insert when the valve stem reciprocates to its lowest point, the hollow insert communicating with a bottom-orificed nozzle tube that exits fluid when communicated from the lower chamber through the hollow insert upon elevation of the valve tip therefrom. Preferred and best mode embodiments and details will hereinafter be presented.

The invention will now be described with reference to the accompanying drawings, FIG. 1 of which is a longitudinal section of the apparatus of the invention in preferred form;

Figure 1:
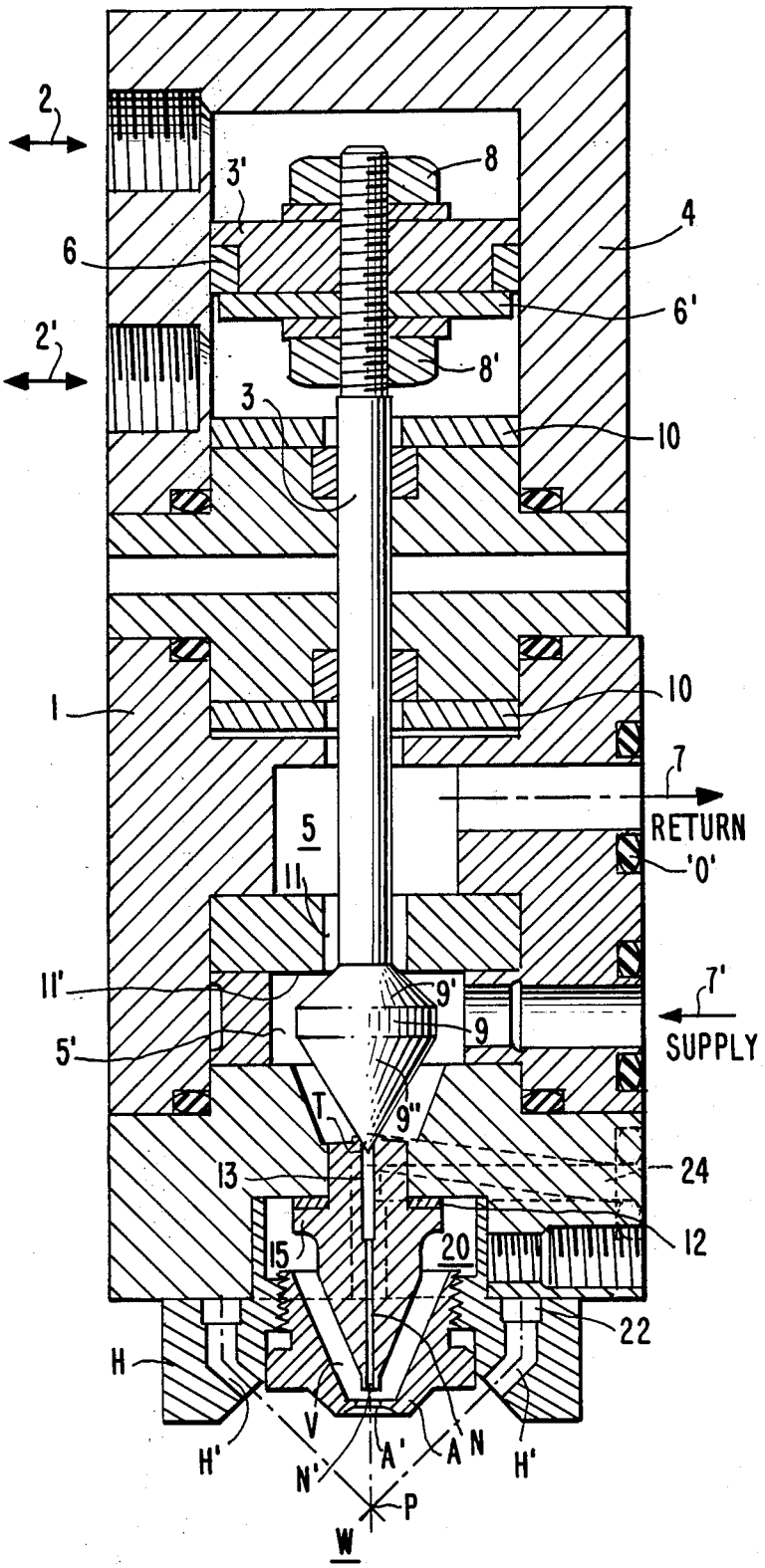
Figure 4:
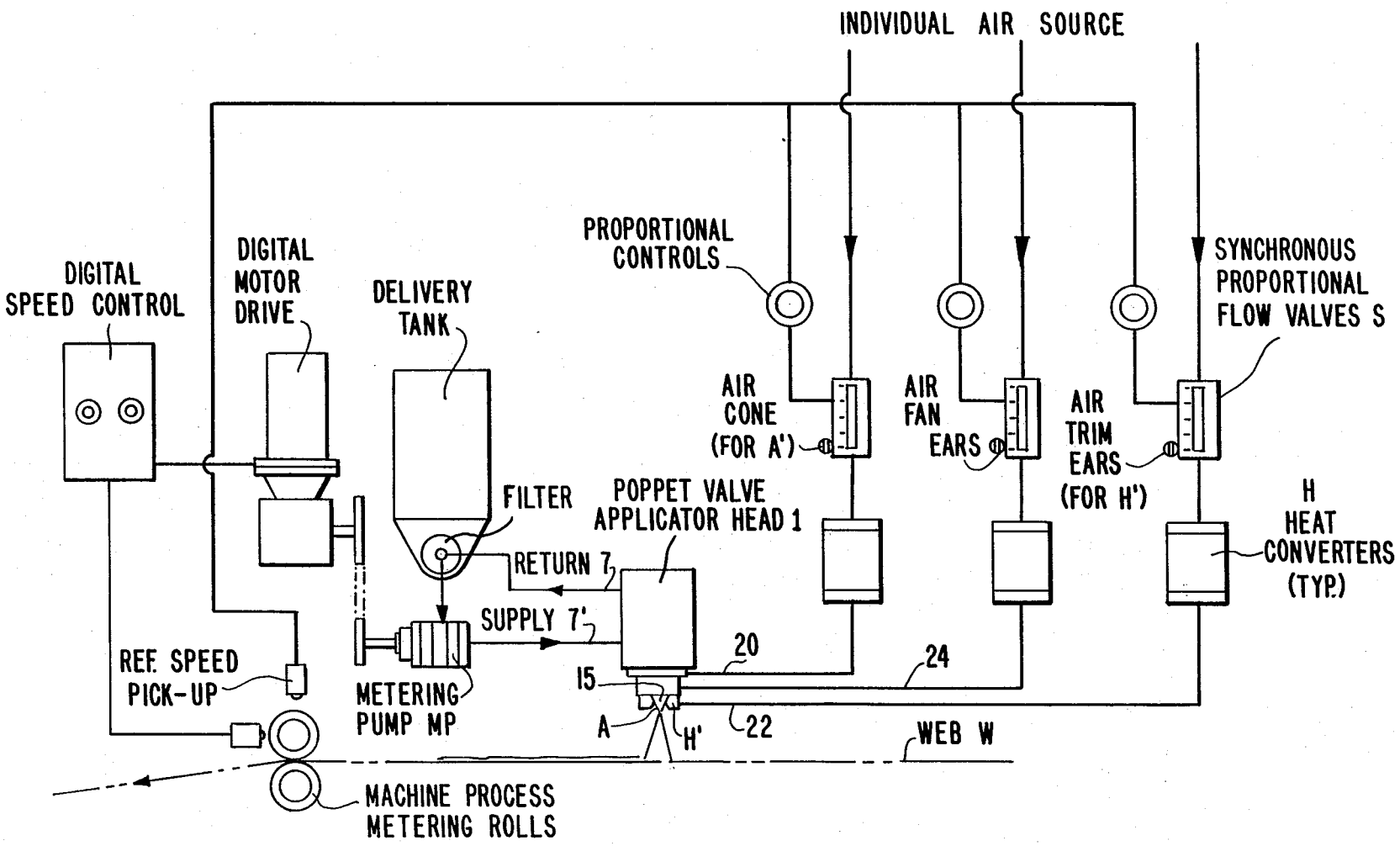
Figure 5:
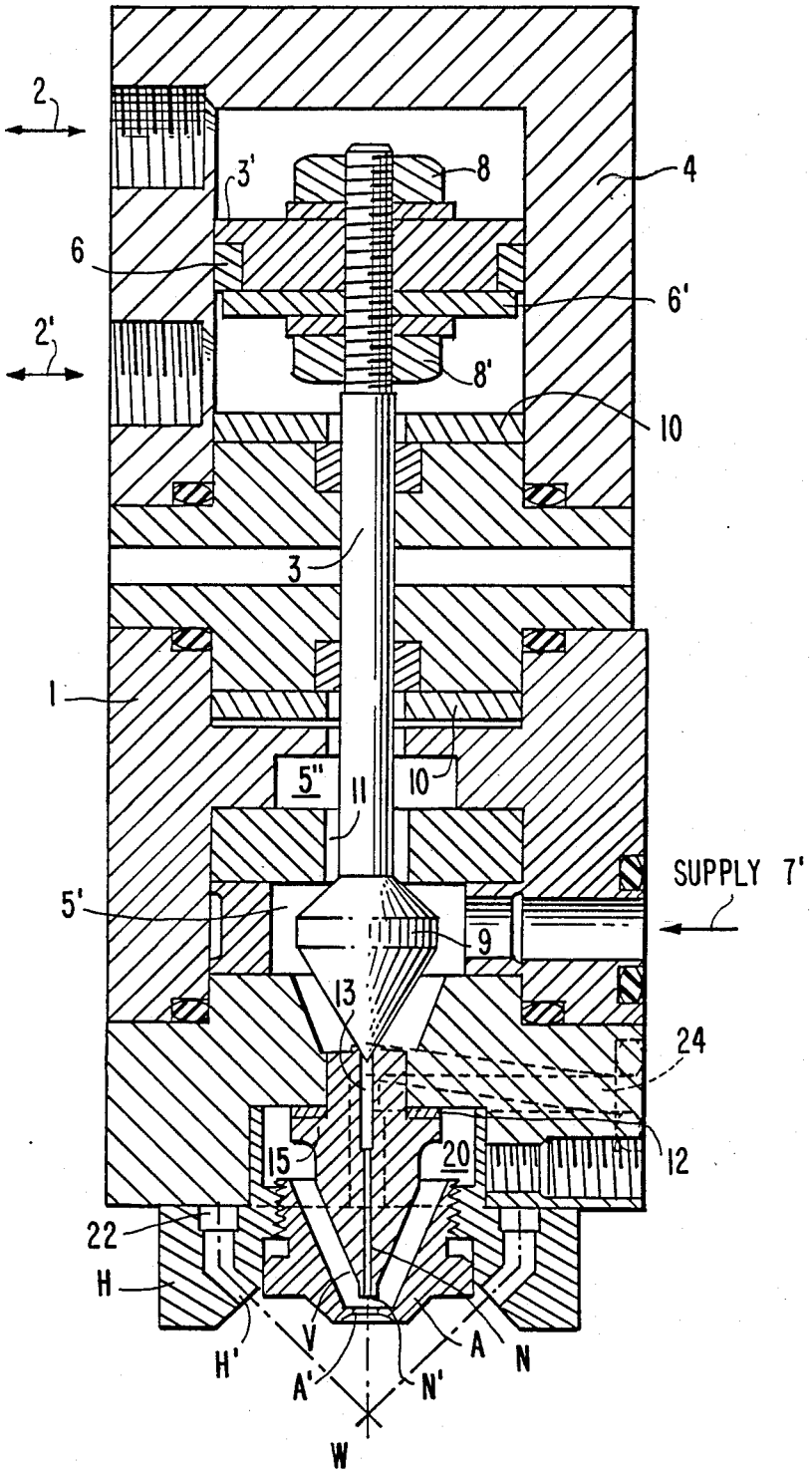
FIG. 5 is a view similar to FIG. 1 of a two-way poppet valve embodying features of the invention.
Figure 6:
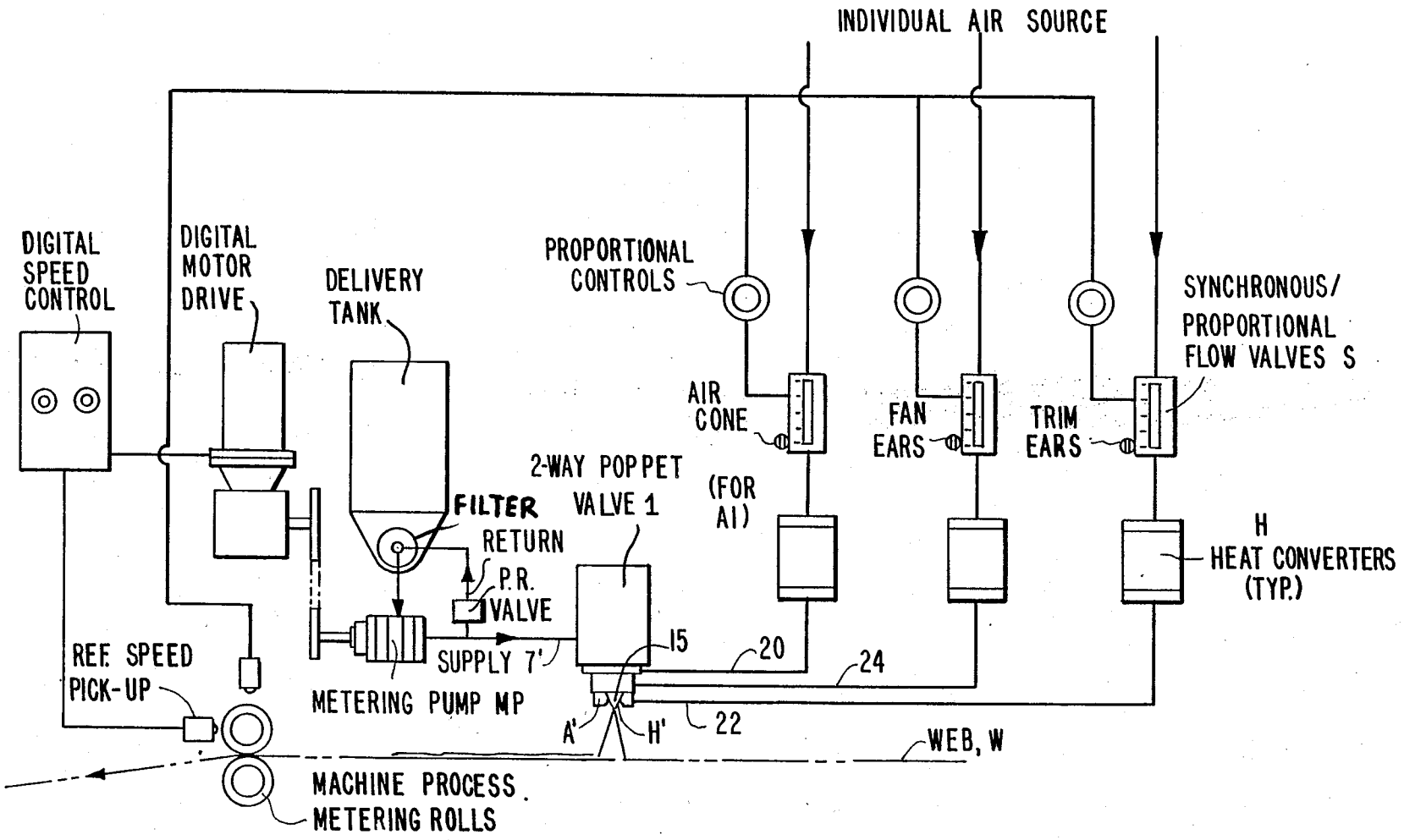
Figure 7A:
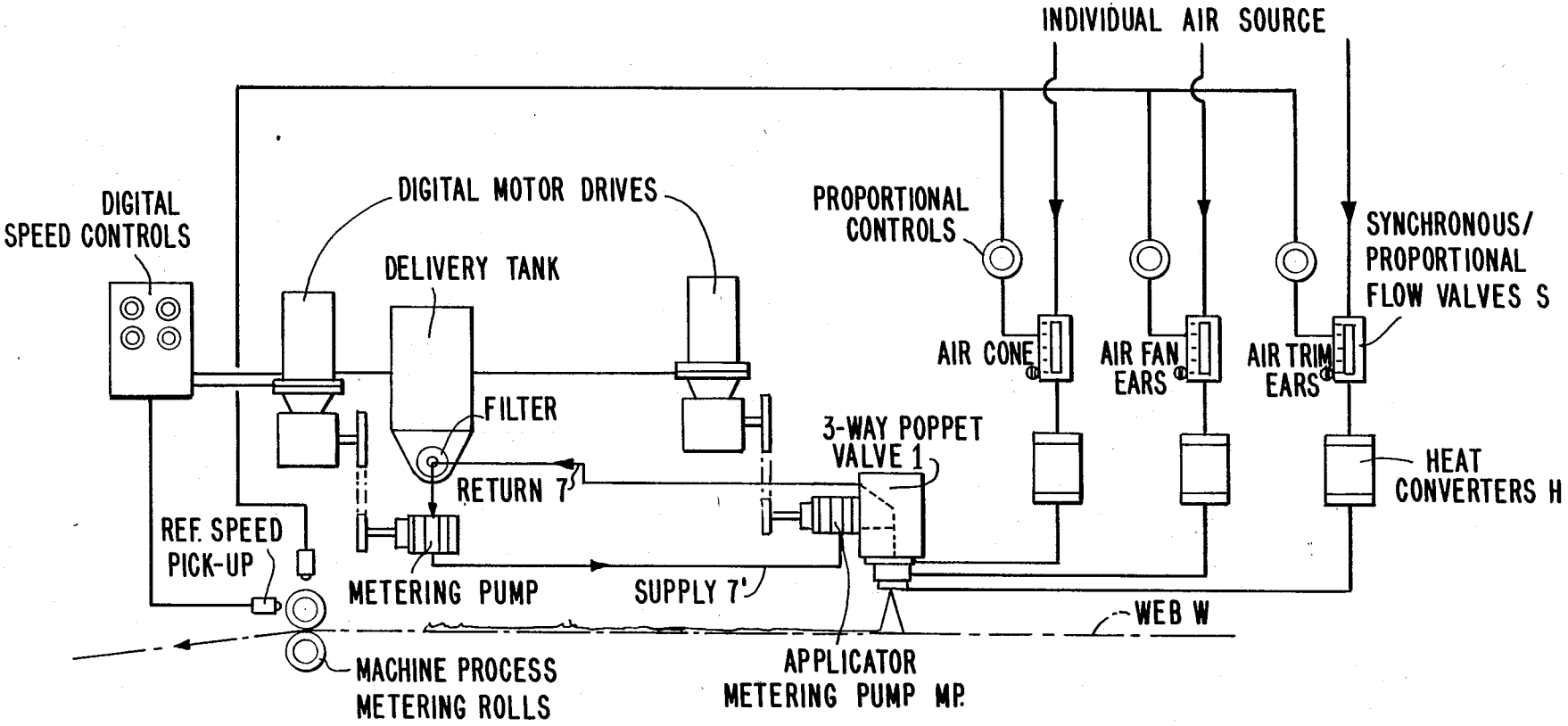
Figure 7B:
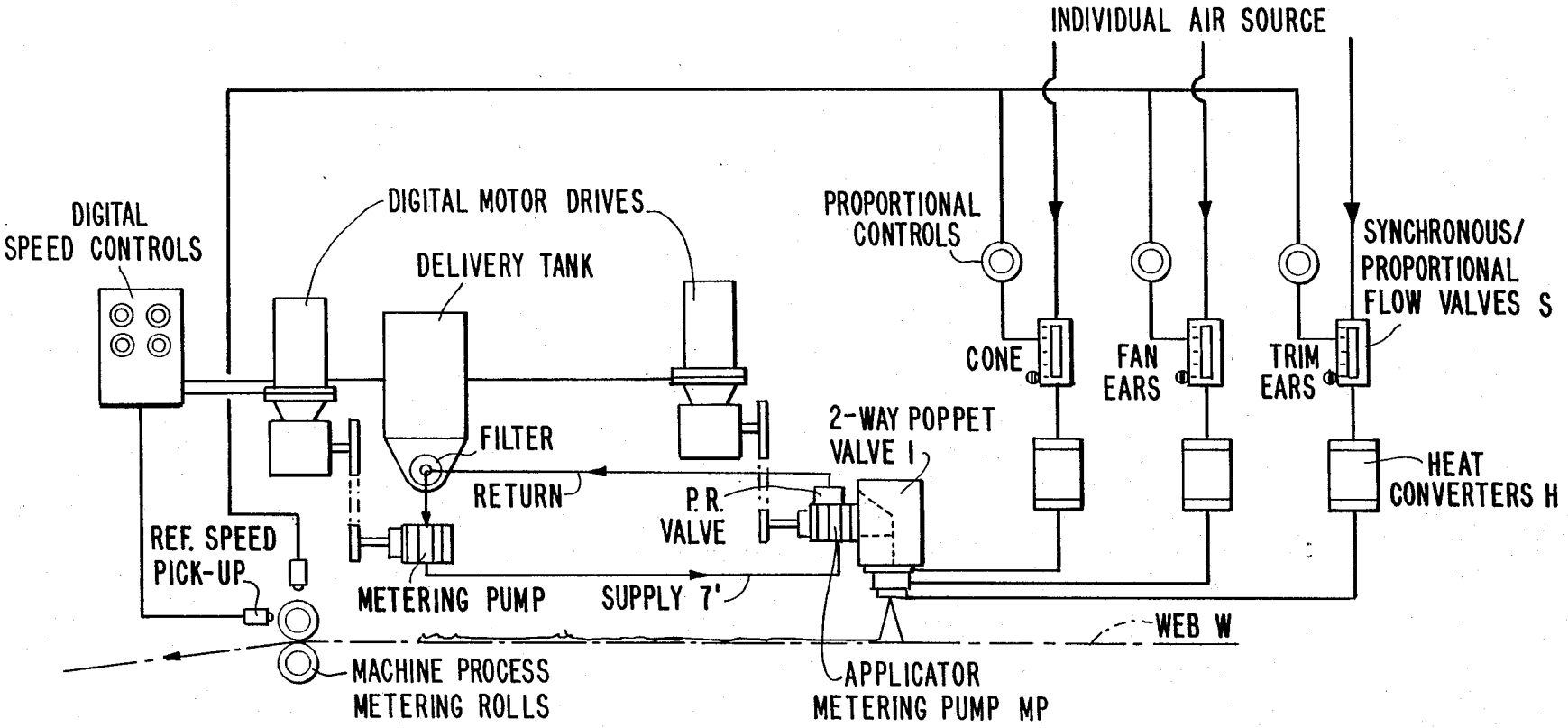

FIGS. 4 and 6 are respectively system block diagrams showing how the valve-nozzles of FIGS. 1 and 5 may be operated for the purposes herein; and FIGS. 7A and 7B illustrate metering pump mounting adjacent the respective three-way and two-way poppet valve nozzle applicator structures of FIGS. 1 and 5 (FIGS. 4 and 6).

Referring to the drawings, for illustrative purposes, as before stated, the invention is first described in connection with a preferred three-way poppet valve of the type disclosed in said U.S. Pat. No. 4,565,217, having a housing or body 1 provided with longitudinally extending valve stem or piston 3 axially reciprocally mounted within communicable upper and lower (as shown) longitudinally displaced fluid chambers 5 and 5'. The lower chamber 5' transversely communicates with a fluid supply source at 7', such as a pressurized metered hot melt or other coating fluid or adhesive fluid supply, as described in said patents, for example, and the upper chamber 5, with a fluid return path 7. The valve piston or stem 3 carries at its lower end, in the orientation shown, a valve head 9 having upwardly and downwardly conical converging sections 9' and 9'' contained within the lower chamber 5'. The upper converging conical section 9', when the stem 3 is reciprocated to its uppermost position, bears against the lower end region 11' of the valve seat opening 11 communicating the lower and upper chambers 5' and 5 to close off such communication. The lower oppositely or downwardly converging conical section 9'' of the poppet valve head 9 terminates in a conical tip T that, when the valve stem reciprocates downwardly to its lowest position or point, enters and blocks off the top of a narrow hollow insert or other recess 13 in the upper portion of a conically terminated extrusion spray or dispensing nozzle 15. The insert or recess 13 communicates directly with a hollow needle-like thinner tube or stem N (that may actually be a hypodermic-like hollow needle or other tube including a tubular recess preformed in the nozzle cone) in the lower portion of the nozzle housing 15 that, when the valve stem tip T is elevated to open fluid communication from the lower chamber 5' into the nozzle hollow insert 13, exits fluid through the lower aperture(s) N' of the needle nozzle tube or stem.

Figure 2:
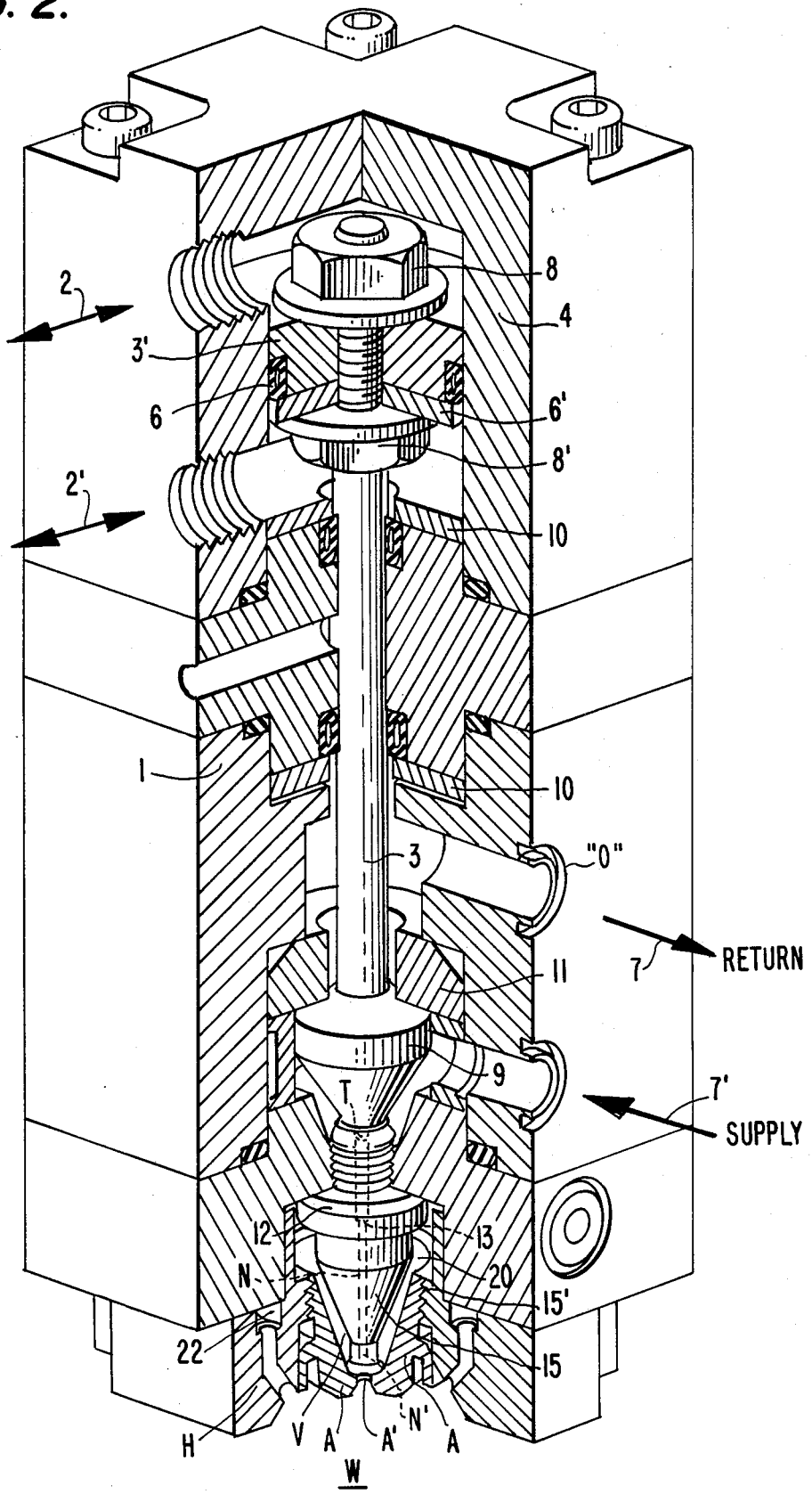
FIG. 2 is an isometric view thereof.
Figure 3A:
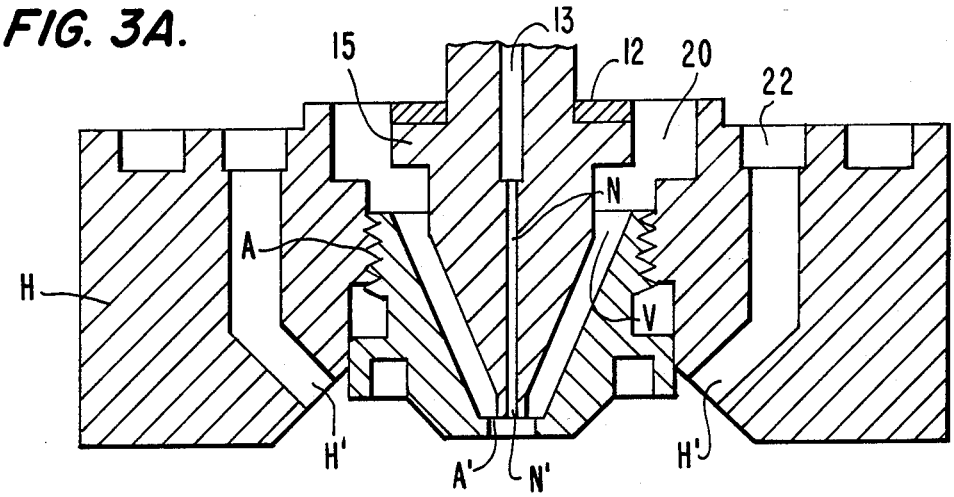
FIGS. 3A, 3B and 3C are fragmentary longitudinal sections of different positions of adjustment of the nozzle portion of the apparatus of FIGS. 1 and 2.
Figure 3B:
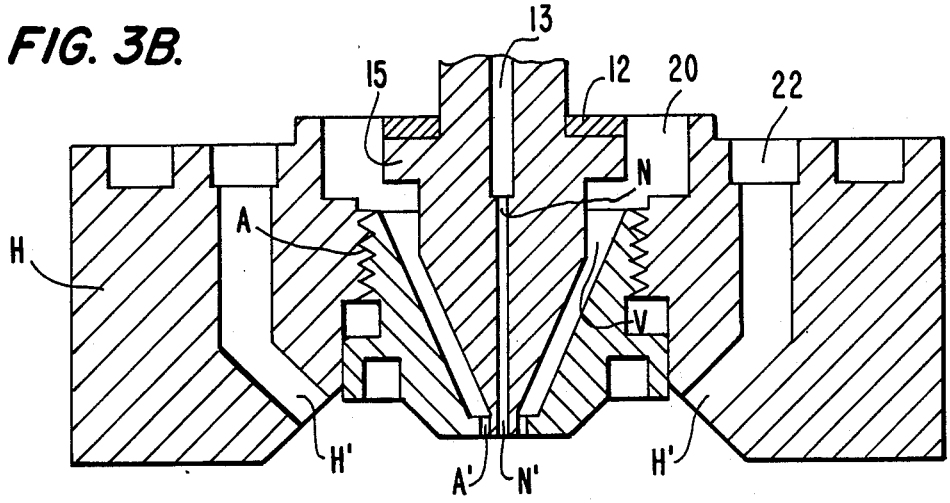

Preferably, as shown in FIGS. 1 and 2, an atomizer head coaxially surrounds the conical nozzle housing 15, but with a V-shaped somewhat conical space V provided therebetween for enabling relative longitudinal adjustment of the position of the nozzle housing 15 and the aperture A' of the head A and for later-described conical air flow when desired. Such adjustment, as by the threaded section 15', FIG. 2 (or other adjustable structure including slidable adjustment), will control the fluid exiting point of the needle, tube or stem opening(s) N' to recessed positions above the aperture A' of somewhat larger diameter (FIG. 3A), or to substantial alignment or a flush position therewith (FIG. 3B), or to extended positions beyond (FIG. 3C), thereby to varying the character of the fluid extrusion for adjustable effects. The recessed position of FIG. 3A has been found to cause the extruded spray to assume a mainly continuous filament or fiber character as air introduced at 20 and conically intersecting the extruded fluid in free flight outside and below the nozzle opening N', bonds or stretches the fluid into a continuous filament form; the flush position of FIG. 3B, producing a combination of fiber or filaments and droplets; and the extended position of FIG. 3C, producing a spray mainly of droplets. This adjustment thus has been found to permit control of the nature of the extruded spray or deposition and the ratio of fibers-to-droplets, for example.

The valve stem 3 is mechanically reciprocated in the illustrative embodiment of FIGS. 1 and 2 by pneumatic pressurized-fluid means acting first downwardly upon the air piston head 3' of the valve stem or piston 3 from air inlet (outlet) 2 in an air manifold body 4 at the top of the valve body 1, and upwardly on the head 3' from the inlet (outlet) 2'. The head 3' is shown provided with a seal 6 and a lower retaining plate 6' (bearing and seal) held on the upper end of the valve stem 3 by hexagonal nuts and washers 8, 8'. Upper and lower retaining plates and piston seals are shown at 10, with '0' rings about the fluid supply and return pipes 7' and 7; and a further seal washer 12 at an upper flange of the extrusion nozzle 15.

Should further control be desired of the nature, shape and pattern and/or distribution of the fluid deposits (filaments or fibers, droplets, etc. or combinations or the same in various proportions) upon the moving web or other surface that may be disposed below the valve-nozzle-aperture head 1–15 (schematically designated by W in FIGS. 1 and 2), the atomizer insert A may be coaxially circumscribed, totally or in sectors, by an outer housing sleeve H. The sleeve H is provided with an air-flow or other fluid flow passage H' external to the member A, supplied at 22, and that terminates in downwardly and centrally inwardly oriented exiting trim ear portions H' to direct further pressurized air or other pressurized fluid) axially inwardly, on the fluid filament shown at the region P in FIG. 1, well below the nozzle and insert openings N'-A'. The inwardly directed air cone provided through the V channel in A, acting symmetrically below the nozzle opening N' and upon the free-flight extruded fluid spray, may be modified, including directionally deflected, by the supplemental trim ear air at H', and has been found remarkably to bond continuous very thin filaments or fibers (order of 0.01 mm) and/or provide droplets or combinations of the same in a controlled and predictable manner to produce the desired coating distribution and dimensions upon the web W, and in either continuous or programmable intermittent fashion. Additional air supplied at 24 and from other ears, labelled "FAN EARS" in FIG. 4, not shown in FIG. 1 but in back of and in front the nozzle section 15, disposed 90° circumferentially displaced from H', for example, can further enable pattern deflection and containing.

Figure 3C:
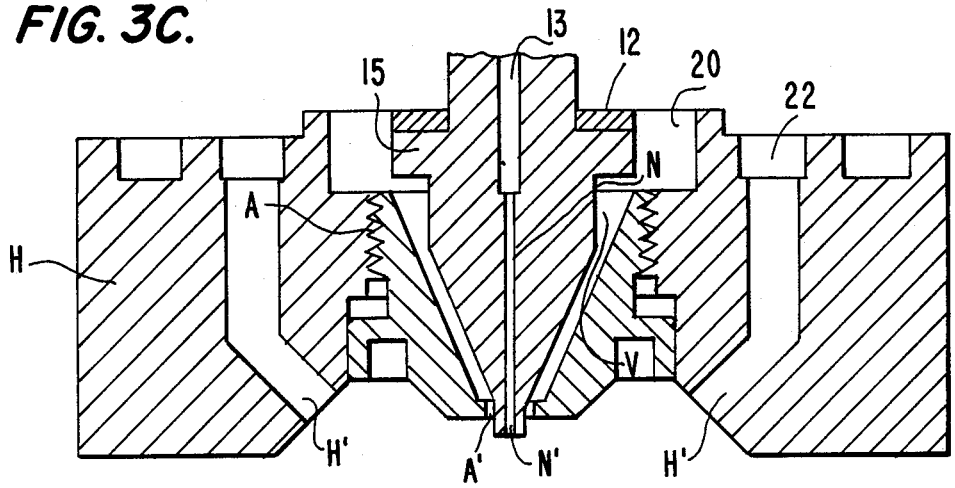

For intermittent operation of the poppet or similar valve 1, it has been found possible even to obtain substantially the same fiber or filament uniform coating patterns of, for example, hot melt elastomeric rubber, acrylic or ethylene vinyl acetate, etc., such as, for example, Findlay Company Type 990–3346, irrespective of intermittency frequency (with fluid volume extrusion synchronized with web speed and synchronized air flow volumes/velocity, where used) over wide ranges of such speeds ranging from about 15 to high 180 meters/minute line speeds, more or less. A hollow needle stem applicator N about 10 mm long and 0.35 mm in diameter, communicating with a carbide wear-resistant insert 13 of about 0.75 mm inside diameter, is useful for this application, with fiber-to-droplet adjustments ranging from about 0.457 mm above A (FIG. 3A) to about 0.457 mm beyond A (FIG. 3C). Air-shaping by air flow volume ranging from about 12 to about 65 liters per minute, directed, for example, at P, approximately 6 mm below the point of release of the fluid, has been found to distribute continuous fibers of the order of .0.01 mm thick over patterns ranging from about 6 mm to 38 mm in width, more or less-and with sharp cut-on and cut-off edges, even at high line speeds, for intermittent operation.

The relatively remote position of the fluid nozzle in my prior U.S. Pat. No. 4,565,217 enabled separation by an intermediate fluid discharge plate; but the additional capacitance effect caused by the remote nozzle positioning was found in some instances to cause heavy droplets of coating fluid when the valve is closed. At high reciprocation rates, moreover, the "pünching" action induces fluid column effects that drive additional fluid through the nozzle during the closing action.

For avoiding such effects, the present invention on the other hand, in effect embeds the fluid nozzle structure 15 into the poppet valve fluid supply chamber 5' and enables direct contact with the poppet valve stem 3, with the dimensions of the hollow insert 13 and the preferably narrower needle tube applicator N adjusted such that the before-mentioned additional capacitance of my prior system is entirely obviated and no spurious fluid droplet deposits after valve closure result. The design thus provides for less fluid displacement during valve closure. In addition the valve stem reciprocating stroke of the present invention has been reduced (to the order of 0.020"—about one-third of that used in prior commercial forms of my before-described patented three-way poppet valve) which prevents any fluid column effect emanating from longer stroke inducement of additional fluid displacement through the nozzle.

A preferred system for operating the poppet-valve-nozzle system of FIGS. 1 and 2 is shown in FIG. 4, with the valve assembly 1 shown supplied by hot melt supply line 7' from the positive displacement metering pump MP, driven by a digital motor drive under the control of a speed control connected with a web-speed pick-up sensor, in conventional fashion, as so-labelled, for preferred synchronous meter fluid volume and web line speed. The air supplied at A' via line 20 ("CONE") and at H' via line 22 (and, if used, from the before-mentioned "FAN EARS") is heated at H in view of the hot melt fluid useage, and its flow (volume/velocity) is also preferably synchronously (proportionally) controlled with fluid volume and web line speed at S.

While the three-way poppet valve herein-described with direct supply line 7' and return 7 to the hot melt source or tank is preferred, the novel nozzle-valve construction and also the novel air interaction structures, if used, may also be employed with two-way poppet valve constructions, though this is not considered as operationally desirable as the three-way valve. Thus, a two-way poppet valve construction is shown in FIG. 5, otherwise similar to the three-way poppet valve of FIGS. 1 and 2, but with a closed upper fluid chamber 5'' that is not returned by a return outlet 7 as in the system of FIG. 4. Instead, the two-way valve system is provided in the supply line 7', FIG. 6, with a pressure relief valve PR designed to operate open for fluid passage when the two-way poppet valve is closed for intermittent ON/OFF operation, and is connected back to the delivery reservoir or supply tank. During closure of the two-way poppet valve, the PR valve will redirect the supply fluid to the reservoir tank. Under certain conditions, the combination of such a two-way poppet valve, together with PR valve, will provide for reasonably satisfactory operation, effective up to the point when the PR valve becomes operational, and therefore partially or totally directing all fluid through the PR valve and no fluid to the head 1, by-passing the head and supply chamber 5'.

For excellent uniform hot melt thin fiber-filament coatings, moreover, it has been found important to locate the poppet-valve fluid metering pump right at, or adjacent the poppet valve 1. The mounting of the metering pump to the valve assembly is therefore shown in FIGS. 7A and 7B for the three-way and two-way poppet valve assemblies of FIGS. 1 and 5 (FIGS. 4 and 6), respectively.

Further modifications will occur to those skilled in this art, including the use of other types of valving (though generally properly generically describable as "poppet"-type), and other types of fine spray nozzles or orifices, and such are considered to fall within the spirit and scope of the invention as defined in the appended claims.

What is claimed is:

1. A poppet valve-controlled fluid nozzle applicator system having, in combination, a longitudinally extending valve stem reciprocally mounted within communicable upper and lower longitudinally displaced fluid chambers, the lower of which transversely communicates with a pressurized and metered fluid supply source and the upper of which communicates transversely with a fluid return path, the valve stem carrying a poppet valve having upwardly and downwardly converging surfaces and constrained within the lower chamber, the region of communicating of the upper and lower chambers comprising a valve seat against which the upwardly converging surface of the poppet valve may bear to close off the upper chamber from the lower chamber when the valve stem reciprocates to an uppermost position, the downwardly converging surface of the poppet valve terminating in a valve tip; a nozzle mounted to depend from a region of lowermost reciprocation of the valve tip, said nozzle having a first passage therein with an opening at an upper end thereof into which the valve tip may fit to block fluid flow from the lower chamber into said passage when the valve stem reciprocates to a lowermost position, said valve tip engaging a portion of said nozzle surrounding said opening along a line-contact circle the diameter of which has a magnitude that is a minor portion of the magnitude of the diameter of said poppet valve, said nozzle having a second passage therein that is substantially narrower than the first passage, said second passage having an upper end that communicates directly with the lower end of said first passage and having a lower end with a fine bottom orifice through which fluid exits upon elevation of the valve tip from said region of lowermost reciprocation; a dispensing head disposed about said nozzle and having a bottom aperture in substantial alignment with the bottom orifice of the nozzle, said dispensing head having means for adjusting the position of said dispensing head relative to said nozzle within a range of positions from a position at which said bottom orifice of said nozzle is just above said bottom aperture of said dispensing head, through a position at which said orifice and said aperture are substantially flush with one another, to a position at which said orifice is below said aperture, said nozzle having a conical outer surface with an apex region adjacent to said bottom orifice and said dispensing head having a conical inner surface surrounding and spaced from said conical outer surface of said nozzle and having an apex region adjacent to said bottom aperture; and means for directing air conically convergingly inward in the space between said conical surfaces and thereafter upon fluid exiting from said orifice as the fluid is in free flight therefrom, and in which said nozzle has a cylindrical portion terminating said apex region thereof whereby said conically convergingly inward directed air is redirected along the direction of fluid exiting from said bottom orifice, the diameter of said aperture being greater than the diameter of said cylindrical portion so that said aperture remains open even when said cylindrical portion is within said aperture.

2. An apparatus as claimed in claim 1 and in which means is provided for rapidly and intermittently reciprocating the valve stem and poppet valve to cause intermittent flow of fluid through said bottom orifice of the nozzle.

3. An apparatus as claimed in claim 1 and in which means is provided for driving the valve stem to its uppermost position to permit a continuous flow of fluid through the bottom orifice of said nozzle until the valve stem is reciprocated to its lowermost position.

4. An apparatus as claimed in claim 1 and in which said nozzle comprises wear-surface material, such as carbide steel, for engagement with said valve tip.

5. An apparatus as claimed in claim 1 and in which the valve stem reciprocation is controlled by pressurized-fluid means.

6. An apparatus as claimed in claim 1 and in which means is provided for directing air conically convergingly inward upon fluid exiting from said aperture of said dispensing head as the fluid is in free flight therefrom.

7. An apparatus as claimed in claim 1 and in which said fluid supply source comprises metering pump means, said valve stem reciprocates in a housing containing said chambers, and said metering pump means is mounted on said housing.

8. A poppet valve-controlled fluid nozzle applicator system having, in combination, a longitudinally extending, reciprocally mounted valve stem carrying a poppet valve constrained within a fluid supply chamber communicating with a pressurized and metered fluid supply source, said poppet valve having a downwardly converging surface terminating in a valve tip; a nozzle mounted to depend from a region of lowermost reciprocation of the valve tip, said nozzle having a first passage therein with an opening at an upper end thereof into which the valve tip may fit to block fluid flow from said chamber into said passage when the valve stem reciprocates to a lowermost position, said valve tip engaging a portion of said nozzle surrounding said opening along a line-contact circle the diameter of which has a magnitude that is a minor portion of the magnitude of the diameter of said poppet valve, said nozzle having a second passage therein that is substantially narrower than the first passage, said second passage having an upper end that communicates directly with the lower end of said first passage and having a lower end with a fine bottom orifice through which fluid exits upon elevation of the valve tip from said region of lowermost reciprocation; a dispensing head disposed about said nozzle and having a bottom aperture in substantial alignment with the bottom orifice of the nozzle, said dispensing head having means for adjusting the position of said dispensing head relative to said nozzle within a range of positions from a position at which said bottom orifice of said nozzle is just above said bottom aperture of said dispensing head, through a position at which said orifice and said aperture are substantially flush with one another, to a position at which said orifice is below said aperture, said nozzle having a conical outer surface with an apex region adjacent to said bottom orifice and said dispensing head having a conical inner surface surrounding and spaced from said conical outer surface of said nozzle and having an apex region adjacent to said bottom aperture; and means for directing air conically convergingly inward in the space between said conical surfaces and thereafter upon fluid exiting from said orifice as the fluid is in free flight therefrom, and in which said nozzle has a cylindrical portion terminating said apex region thereof whereby said conically convergingly inward directed air is redirected along the direction of fluid exiting from said bottom orifice, the diameter of said aperture being greater than the diameter of said cylindrical portion so that said aperture remains open even when said cylindrical portion is within said aperture.

9. An apparatus as claimed in claim 8 and in which means is provided for rapidly and intermittently reciprocating the valve stem and poppet valve to cause intermittent flow of fluid through said bottom orifice of the nozzle.

10. An apparatus as claimed in claim 8 and in which means is provided for driving the valve stem to its uppermost position to permit a continuous flow of fluid through the bottom orifice of said nozzle until the valve stem is reciprocated to its lowermost position.

11. An apparatus as claimed in claim 8 and in which said nozzle comprises wear-surface material, such as carbide steel, for engagement with said valve tip.

12. An apparatus as claimed in claim 8 and in which the valve stem reciprocation is controlled by pressurized-fluid means.

13. An apparatus as claimed in claim 8 and in which means is provided for directing air conically convergingly inward upon fluid exiting from said aperture of said dispensing head as the fluid is in free flight therefrom.

14. An apparatus as claimed in claim 8 and in which the fluid supply source comprises metering pump means connected to said chamber by a supply line and provided with a by-pass through a pressure relief valve.

15. An apparatus as claimed in claim 8 and in which said valve stem reciprocates in a housing containing said chamber and said metering pump is mounted on said housing.

* * * * *